United States Patent [19]

Yoshieda et al.

[11] Patent Number: 4,633,580

[45] Date of Patent: Jan. 6, 1987

[54] DEVICE FOR POSITIONING SLIDE FASTENER STRINGERS IN FASTENER FINISHING APPARATUS

[75] Inventors: Keiichi Yoshieda, Kurobe; Toshiaki Sodeno, Toyama; Syuichi Honmoto, Uozu, all of Japan

[73] Assignee: Yoshida Kogyo K. K., Tokyo, Japan

[21] Appl. No.: 763,625

[22] Filed: Aug. 8, 1985

[30] Foreign Application Priority Data

Aug. 14, 1984 [JP] Japan ..... 59-124144[U]

[51] Int. Cl.[4] ..... A41H 37/06

[52] U.S. Cl. ..... 29/767; 29/766; 29/33.2

[58] Field of Search ..... 29/408–410, 29/766–770, 33.2

[56] References Cited

U.S. PATENT DOCUMENTS

| | | | |
|---|---|---|---|
| 3,714,698 | 2/1973 | Fukuroi | 29/408 |
| 4,299,027 | 11/1981 | Yosheida et al. | 29/767 |
| 4,392,291 | 7/1983 | Iai | 29/766 |
| 4,494,293 | 1/1985 | Kawakami | 29/768 |
| 4,580,326 | 4/1986 | Kawakami et al. | 29/766 |

FOREIGN PATENT DOCUMENTS 4944243 11/1974 Japan .

*Primary Examiner*—Howard N. Goldberg
*Assistant Examiner*—Steven Nichols
*Attorney, Agent, or Firm*—Hill, Van Santen, Steadman & Simpson

[57] ABSTRACT

A device for positioning a pair of longitudinally advancing elongate slide fastener stringers comprises a pair of positioning jaws movable relatively to one another in a direction substantially perpendicular to the plane of each slide fastener stringer to define therebetween a guide channel for the passage of the slide fastener stringer. At least one of the positioning jaws includes a step for engaging the leading coupling element of each coupling element row mounted on one longitudinal edge of a tape of each respective slide fastener stringer, for thereby stopping the slide fastener stringer. The positioning device having the positioning jaws is capable of accurately positioning the slide fastner stringers even when the slide fastener stringer is laterally undulated or locally swelled during advancing movement thereof.

8 Claims, 14 Drawing Figures

DEVICE FOR POSITIONING SLIDE FASTENER STRINGERS IN FASTENER FINISHING APPARATUS

BACKGROUND OF THE INVENTION

1. Field of the Invention

The present invention relates to a positioning device for positioning and stopping slide fastener stringers in an apparatus for finishing slide fasteners.

2. Description of the Prior Art

One typical positioning device incorporated in a slide fastener finishing apparatus is disclosed in Japanese Patent Publication No. 49-44243 published on Nov. 27, 1984. The disclosed positioning device is generally shown in FIG. 10 of the accompanying drawings and comprises a pair of stopper arms A, A disposed below a pair of elongate slide fastener stringers B, B, respectively, fed by a pair of grippers C, C movable along a feed path for a predetermined interval. Each of the slide fastener stringers includes a plurality of rows of coupling elements mounted on and along one longitudinal edge of a stringer tape at longitudinal intervals. The positioning stopper arms A, A have bifurcated upper ends and are vertically movable to receive the longitudinal tape edges in their bifurcated upper ends for engaging the leading coupling element, thereby detecting slide fastener stringers B, B having travelled over the predetermined interval. In response to this detection, the grippers C, C are stopped and the slide fastener stringers B, B are cut by a pair of cutters G, G across element-free portions into individual fastener lengths which are then fed along to a discharge position. The slide fastener finishing apparatus also includes an end stop attachment unit D for attaching end stops to the slide fastener stringers B, B, a slider applicator E for mounting sliders F successively to the slide fastener stringers B, B, and a pair of grippers H, H movable along the feed path for feeding the slide fastener stringers B, B through the finishing apparatus.

Since the positioning stopper arms A, A move respectively in the same plane as the slide fastener stringers so as to receive the longitudinal tape edges in the bifurcated upper ends, the bifurcated upper ends are likely to miscatch the longitudinal tape edges when the stringer tapes are laterally undulated or locally swelled during advancing movement thereof. Such miscatched stringer portions could not be properly processed in the following processing stations and hence would result in unuseable slide fasteners.

SUMMARY OF THE INVENTION

It is an object of the present invention to provide a positioning device for positioning slide fastener stringers properly in a desired location to thereby ensure proper processing of the slide fastener stringers at the following processing stations.

Another object of the present invention is to provide a positioning device which is capable of accurately positioning slide fastener stringers even when the slide fastern stringers are laterally undulated or locally swelled during advancing movement thereof.

According to the present invention, a device for positioning a pair of longitudinally advancing elongate slide fastener stringers comprises a pair of positioning jaws movable relatively to one another in a direction substantially perpendicular to the plane of each slide fastener stringer to define therebetween a guide channel for the passage of the slide fastener stringer. At least one of the positioning jaws includes a step for engaging the leading coupling element of each coupling element row mounted on one longitudinal edge of a tape of each respective slide fastener stringer, thereby stopping the slide fastener stringer.

DETAILED DESCRIPTION

Figure 1:
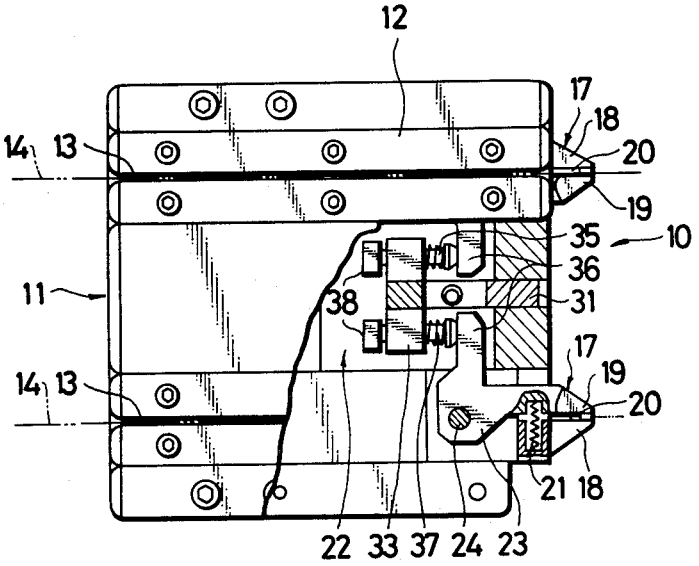
FIG. 1 is a plan view, partly cut away, of a positioning device according to the present invention, the positioning device being combined with a stringer guide unit.
Figure 5:
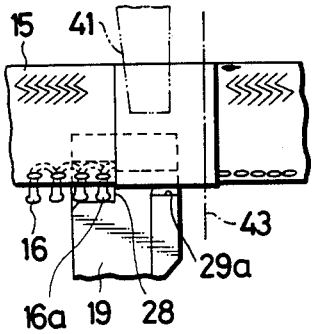
FIG. 5 is a schematic front elevational view of FIG. 4*c*, with the stationary positioning jaw omitted for clarity.
Figure 6:
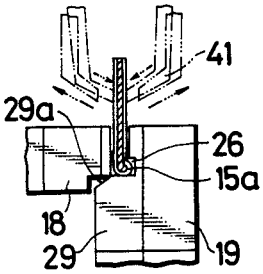
FIG. 6 is a schematic side elevational view of FIG. 4*c*.

As shown in FIG. 1, a positioning device 10 embodying the present invention is combined with a stringer guide unit 11 incorporated in a slide fastener finishing apparatus, not shown. The stringer guide unit 11 includes a horizontal guide table 12 having a pair of laterally spaced guide grooves 13, 13 for the passage therethrough of a pair of elongate slide fastener stringers 14, 14, respectively. Each of the slide fastener stringers 14 includes, as shown in FIG. 5, an elongate stringer tape 15 and a plurality of rows of coupling elements 16 (one being shown) supported on and along one longitudinal edge of the stringer tape 15. The coupling elements 16 are formed from a thermoplastic filamentary material into a coil and are mounted on one surface of the stringer tape 15 along the longitudinal edge thereof. The element-supporting longitudinal tape edge is beaded at 15*a* as shown in FIG. 6. The slide fastener stringers 14, 14 are fed longitudinally to the right in FIG. 1 through the guide grooves 13, 13 in vertical orientation with the element-supporting longitudinal tape edges facing downwardly.

The positioning device 10 comprises a pair of laterally spaced stoppers 17, 17 each composed of a pair of positioning jaws 18, 19 disposed adjacent to the outlet openings of the respective guide grooves 13, 13 and projecting from the guide table 11 in the direction of the movement of the slide fastener stringers 14, 14. The outer positioning jaws 18, 18 are fixedly secured to the guide table 12 while the inner positioning jaws 19, 19 are pivotably mounted on the support table 12 and angularly horizontally movable toward and away from the mating stationary positioning jaws 18, 18 to define therebetween a pair of guide channels 20, 20 contiguous to the corresponding guide grooves 13, 13 in the guide table 12. A compression coil spring 21 is disposed in recesses defined respectively in the stationary and movable positioning jaws 18, 19 and acts therebetween to urge the movable positioning jaw 19 to be retracted away from the stationary positioning jaw 18. The movable positioning jaws 19, 19 are actuated to move toward the mating stationary jaw 18 by means of a drive mechanism 22 described below.

Figure 3:
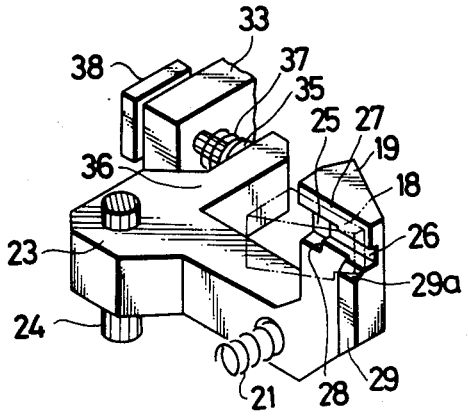
FIG. 3 is an enlarged perspective view of a portion of the positioning device, showing movable and stationary positioning jaws.

Each of the movable positioning jaws 19 is disposed on an end of an L-shaped lever 23 pivotably centrally supported by a pivot pin 24 on the guide table 12. As shown in FIG. 3, the positioning jaw 19 has first and second horizontal recesses 25, 26 defined in a flat vertical surface 27 thereof and separated by a step 28 extending perpendicularly to the vertical surface 27. The first recess 25 is deeper than the second recess 26 and disposed adjacent to the guide table 12 so that a leading portion of each row of coupling elements 16 and the beaded longitudinal tape edge 15*a* are received, respectively, in the first and second recesses 25, 26 as each slide fastener stringer 14 is advanced along a feed path. The step 28 is engageable with the leading coupling element 16*a* (FIGS. 4*b*, 4*c* and 5) to stop the slide fastener stringer 14. The movable positioning jaw 19 further includes a lateral nose 29 disposed on the vertical surface 27 below the second recess 26 and has a sloped guide surface 29*a* extending downwardly outwardly from the lower edge of the second recess 26. As the movable positioning jaw 19 is moved toward the stationary positionng jaw 18, the sloped guide surface 29*a* engages the longitudinal tape edge 15*a* to urge the slide fastener stringer 14 upwardly when the slide fastener stringer 14 is fed below a desired level. Thus, the longitudinal tape edge 15*a* can properly be introduced into the second recess 26. The stationary positioning jaw 18 has a flat vertical surface 30 confronting the vertical surface 27 of the movable positioning jaw 19.

Figure 2:
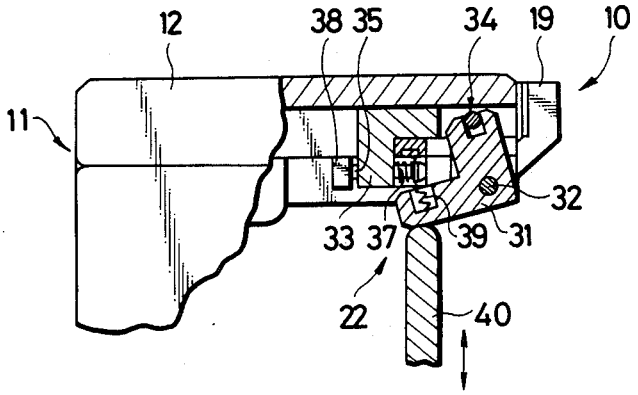
FIG. 2 is a fragmentary front elevational view of FIG. 1, showing the positioning device in cross section.

The drive mechanism 22 is constructed to actuate the L-shaped levers 23, 23 in unison to angularly move the positioning jaws 19, 19 toward and away from the mating positioning jaws 18, 18. As shown in FIGS. 1 and 2, the drive mechanism 22 comprises an L-shaped rocking lever 31 disposed vertically between the L-shaped levers 23, 23 and pivotably centrally supported by a pin 32 on the guide table 12, a slider 33 slidably mounted on the underside of the guide table 12 and coupled with one arm of the rocking lever 31 via a pin-and-recess coupling 34, and a pair of laterally spaced horizontal push rods 35, 35 slidably mounted in the slider 33 and each having one end, respectively, held in engagement with the other arms 36, 36 of the respective L-shaped levers 23, 23. The rocker lever 31 is urged counterclockwise in FIG. 2 by means of a compression coil spring 39 acting between the other arm of the rocking lever 31 and the guide table 12. The push rods 35, 35 have respective other ends 38, 38 enlarged to serve as stops. A pair of compression springs 37, 37 acts between the respective push rods 35, 35 and the slider 33 to urge the latter against the enlarged stops 38, 38. The springs 39, 39 are stronger than the springs 21, 21. A vertical actuating bar 40 is reciprocably disposed below the rocking lever 31 and acts on the other arm of the latter to angularly move the rocking lever 31. With the drive mechanism 22 thus constructed, linear movement of the actuating rod 40 is converted to angular movement of the positioning jaws 19, 19 through the rocking lever 31, slider 33 and push rods 35, 35.

Figure 4A:
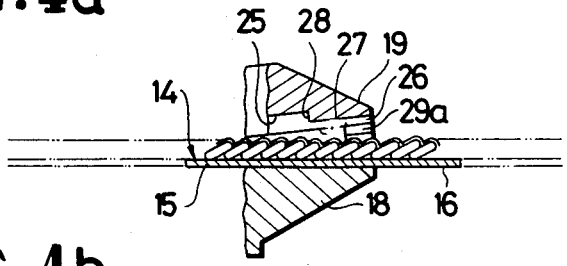
FIGS. 4*a* to 4*c* are horizontal cross-sectional views of the positioning jaws illustrating operation of the positioning device.
Figure 4B:
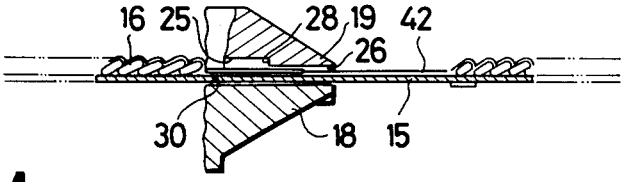
Figure 4C:
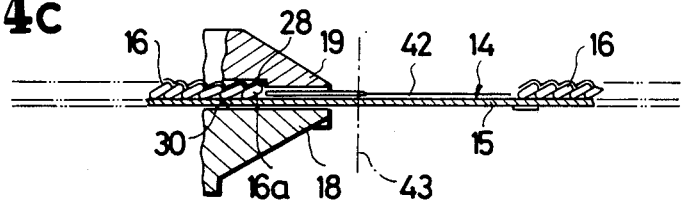

The actuating bar 40 is normally retracted downwardly so that the movable positioning jaws 19, 19 are retracted away from the stationary positioning jaws 18, 18 by the force of the compression coil springs 21. In this condition, the row of coupling elements 16 can pass through an enlarged guide channel between each pair of positioning jaws 18, 19 as the slide fastener 14 is advanced, as shown in FIG. 4*a*. Each of the fastener stringers 14, 14 is longitudinally fed by a pair of longitudinally spaced grippers 41 (one being shown in FIGS. 5 and 6) through the guide unit 11 and the positioning device 10. Since the positioning device 10 is constructed to simultaneously position the two slide fastener stringers 14, 14, operation of the device 10 is described with respect to a single slide fastener stringer 14. When an element-free portion 42 of the slide fastener stringer 14 is detected by a suitable sensor, such as a limit switch at a position upstream of the positioning jaws 18, 19, the actuating bar 40 is operated to extend upwardly to angularly move the L-shaped lever 31 clockwise (FIG. 2) against the bias of the spring 39. This angular movement of the lever 31 causes the slider 33 to slide over the push rods 35, 35 toward the arms 36, 36 of the respective levers 23, 23, against the bias of the compression coil springs 21, 37. Since the springs 37, 37 are stronger than the springs 21, 21, continuing sliding movement of the slider 33 causes the push rods 35, 35 to move along with the slider 33, to thereby angularly move the positioning jaws 19, 19 toward the mating positioning jaws 18, 18. Thus the positioning jaws 18, 19 are located in an operating position shown in FIG. 4*b*. As the slide fastener stringer 14 is further advanced by the gripper 41 the leading coupling element 16*a* next to the element-free portion 41 abuts against the step 28 of the positioning jaw 19, as shown in FIG. 4*c* whereupon the advancing movement of the gripper and hence the slide fastener stringer 14 is stopped. Then the gripper 41 grips the element-free portion 42 and thereafter the slide fastener stringer 14 is severed across the element-free portion 42 along a line 43 into a slide fastener of unit length.

Figure 7A:
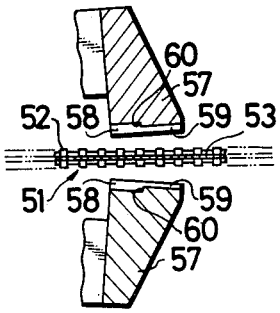
FIGS. 7*a* to 7*c* are cross-sectional views similar to FIGS. 4*a* to 4*c* showing another embodiment.
Figure 7B:
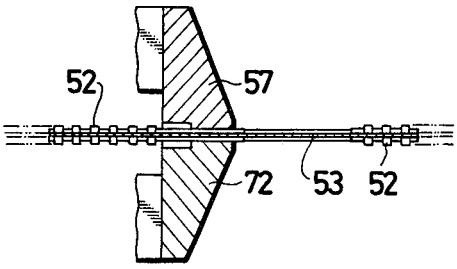
Figure 7C:
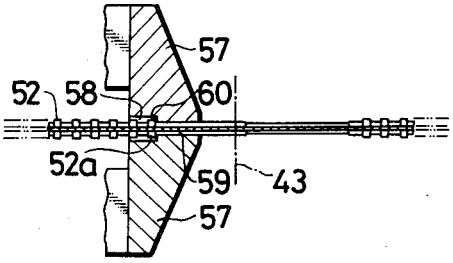
Figure 8:
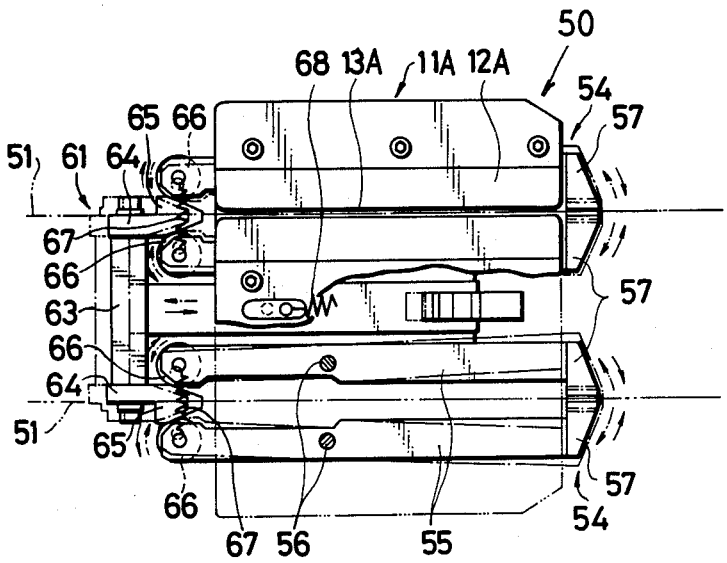
FIG. 8 is a plan view, partly cut away, of a modified positioning device having two such movable jaws as shown in FIGS. 7*a* to 7*c*.
Figure 9:
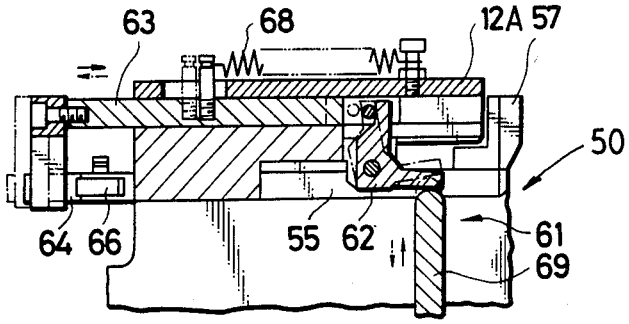
FIG. 9 is a vertical cross-sectional view of the positioning device shown in FIG. 8.
Figure 10:
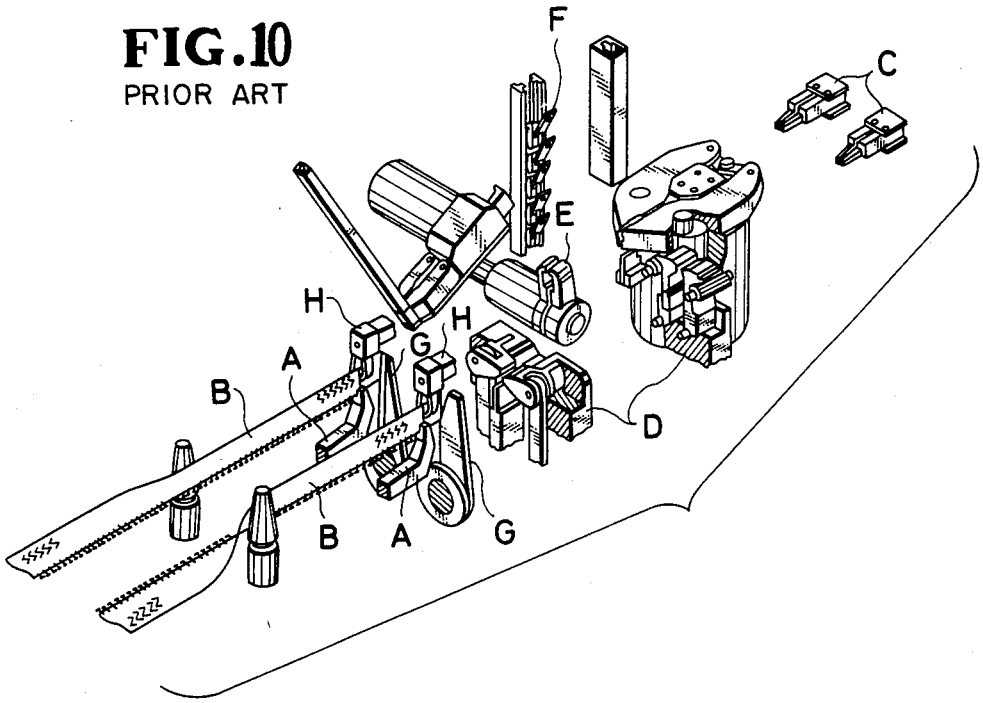
FIG. 10 PRIOR ART
FIG. 10 is an exploded perspective view of a slide fastener finishing apparatus having an earlier positioning device.

FIGS. 8 and 9 show a modified positioning apparatus 50 which is suitable for use with a slide fastener stringer 51 shown in FIGS. 7*a* to 7*c*. The slide fastener stringer 51 includes a row of coupling elements 52 mounted on a stringer tape 53 astride one longitudinal edge of the tape 53 at longitudinal intervals. The positioning device 50 comprises a pair of stoppers 54, 54 each including a pair of laterally spaced elongated levers 55, 55 pivotably centrally supported by a pair of pins 56, 56, respectively, on the underside of a guide table 12A of a stringer guide unit 11A. The levers 55, 55 have a pair of positioning jaws 57, 57 on their one end adjacent to the outlet opening of a guide groove 13A in the guide table 12A.

The jaws 57, 57 are constructed in mirror image and each has a pair of first and second recesses 58, 59 for receiving the coupling elements 52 and the longitudinal tape edge, respectively. The recesses 58, 59 are separated by a step 60 which is engageable with the leading coupling element 52*a* to stop the slide fastener stringer 51.

The positioning jaws 57, 57 are actuated by a drive mechanism 61 which comprises an L-shaped rocking lever 62 pivotably mounted on the guide table 12A and having one arm coupled with a slider 63 slidably mounted on the guide table 12A and a pair of push rods 64, 64 secured to the slider 63, each of the push rods 64, 64 having a pair of wedge like cams 65 disposed between a pair of rollers or cams followers 66, 66 rotatably mounted on the other ends of each of the pair of levers 55, 55. The levers 55, 55 are urged by a tension coil spring 67 to move the positioning jaws 57, 57 away from one another and to move the cam followers 66, 66 into engagement with the cams 65. A tension coil spring 68 acts between the table 12A and the slider 63 to urge the cam 65 rightward (FIG. 8), thereby moving the positioning jaws 57, 57 toward each other against the bias of the spring 67. A vertical actuating bar 69 acts on the other arm of the L-shaped lever 62 to angularly move the latter. This angular movement of the lever 62 causes the slider 63 and hence the cams 55 to reciprocate along the feed path of the fastener stringer 51, thereby moving the positioning jaws 57, 57 toward and avay from each other.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A device for positioning a pair of longitudinally advancing elongate slide fastener stringers each including a stringer tape and a row of coupling elements supported on and along one longitudinal edge of the stringer tape at longitudinal intervals, said device comprising:

(a) a pair of stoppers for stopping the slide fastener stringers, respectively, each of said stoppers including a pair of positioning jaws movable relatively to one another in a direction substantially perpendicular to the plane of each slide fastener stringer to define therebetween a guide channel for the passage of the slide fastener stringer, at least one of said positioning jaws including a step for engaging the leading coupling element of each coupling element row to stop advancing movment of the slide fastener stringer; and (b) means operatively connected with said positioning jaws for driving them to move relatively to one another.

2. A device according to claim 1, said one positioning jaw being movable and the other positioning jaw being stationary.

3. A device according to claim 1, said pair of positioning jaws being movable and each of said positioning jaws having said step.

4. A device according to claim 1, said one positioning jaw having a first recess for receiving the coupling elements and a second recess for receiving the longitudinal tape edge, said first and second recesses being separated by said step.

5. A device according to claim 4, said one positioning jaw having a sloped surface extending outwardly from said second recess for guiding the longitudinal tape edge into said second recess.

6. A device according to claim 2, said one positioning jaw being disposed on one arm of an L-shaped pivotable lever and being normally urged away from said other positioning jaw by a first spring, said driving means comprising an L-shaped rocking lever angularly movable in a plane parallel to the plane of the slide fastener stringer, a slider coupled with one arm of said L-shaped rocking lever and movable in a plane perpendicular to the plane of the slide fastener stringer, and a push rod mounted on said slider and engaging the other arm of said L-shaped lever to angularly move the latter agaist the bias of said first spring.

7. A device according to claim 6, said push rod being slidably mounted in the slider, said driving means including a second spring acting between said slider and said push rod to urge them away from one another, said second spring being stronger than said first spring.

8. A device according to claim 3, said pair of positioning jaws being disposed on one end of a pair of laterally spaced elongated pivotable levers, respectively, said driving means comprising an L-shaped rocking lever angularly movable in a plane parallel to the plane of the slide fastener stringer, a slider coupled with one arm of said L-shaped rocking lever and movable in a plane perpendicular to the plane of the slide fastener stringer, a cam secured to said slider, a pair of cam followers mounted on the other ends of said elongated pivot levers, respectively, and held in engagement with said cam.

* * * * *